US011150003B2

(12) United States Patent
Bauriedl et al.

(10) Patent No.: US 11,150,003 B2
(45) Date of Patent: Oct. 19, 2021

(54) ICE MAKER WITH SPECIFIC POSITION IDENTIFIER, AND HOUSEHOLD REFRIGERATION APPARATUS

(71) Applicant: BSH HAUSGERAETE GMBH, Munich (DE)

(72) Inventors: Josef Bauriedl, Neunburg (DE); Nilton Bertolini, Knoxville, TN (US); Jorge Carlos Montalvo Sanchez, Knoxville, TN (US); Mathias Sigl, Herbrechtingen (DE)

(73) Assignee: BSH Hausgeraete GmbH, Munich (DE)

( * ) Notice: Subject to any disclaimer, the term of this patent is extended or adjusted under 35 U.S.C. 154(b) by 135 days.

(21) Appl. No.: 16/705,967

(22) Filed: Dec. 6, 2019

(65) Prior Publication Data

US 2021/0172665 A1 Jun. 10, 2021

(51) Int. Cl.
*F25C 5/185* (2018.01)
*F25C 5/20* (2018.01)

(52) U.S. Cl.
CPC ..... *F25C 5/185* (2013.01); *F25C 5/22* (2018.01); *F25C 2400/10* (2013.01); *F25C 2600/04* (2013.01)

(58) Field of Classification Search
CPC .. F25C 2400/10; F25C 2600/04; F25C 5/185; F25C 5/22
See application file for complete search history.

(56) References Cited

U.S. PATENT DOCUMENTS

| | | | | |
|---|---|---|---|---|
| 9,863,684 | B2 * | 1/2018 | Gomes | F25C 5/06 |
| 2017/0370628 | A1 * | 12/2017 | Knatt | F25C 1/25 |
| 2019/0234668 | A1 * | 8/2019 | Yeom | F25C 1/04 |

* cited by examiner

*Primary Examiner* — Filip Zec
(74) *Attorney, Agent, or Firm* — Laurence A. Greenberg; Werner H. Stemer; Ralph E. Locher

(57) ABSTRACT

An ice maker for installation in a household refrigeration apparatus includes a housing with an opening, a storing bowl for ice, wherein the storing bowl is formed with an opening, which is accessible from the top. The storing bowl can be inserted into the housing through the opening of the housing and the storing bowl is arranged in a final position at the housing in the inserted state. A position identifier captures the position of the storing bowl, wherein the position identifier includes a capturing sensor. A control electronic, which is arranged in a front area in depth direction of the ice maker, includes a circuit board. The capturing sensor is arranged on the circuit board.

14 Claims, 7 Drawing Sheets

ICE MAKER WITH SPECIFIC POSITION IDENTIFIER, AND HOUSEHOLD REFRIGERATION APPARATUS

BACKGROUND OF THE INVENTION

Field of the Invention

One aspect of the invention relates to an ice maker for a household refrigeration apparatus. A further aspect of the invention relates to a household cooling appliance with an ice maker.

Ice makers for household refrigeration apparatuses are known. They comprise a storing bowl for ice form parts. Ice form parts can be ice cubes. The ice maker can also comprise an ice producer. The ice form parts are generated by it. Thereto, an ice tray is provided. Form areas are formed in it, into which water can be introduced. This water is frozen to the ice form parts in the ice producer. The storing bowl for this ice is arranged in a housing of the ice maker. This storing bowl is displaceably arranged in the housing.

In order to be able to correspondingly isolate the ice maker in its environment, the storing bowl is to be attached in a defined final position. Thereby, the storage conditions in the interior of the ice maker can be maintained. The exit of cold air from the ice maker can thereby be avoided. Thus, it is important to be able to securely adjust the final position of the storing bowl.

SUMMARY OF THE INVENTION

It is the object of the present invention to provide an ice maker, in which the interior of the ice maker is best possible shielded towards the environment and a storing bowl of the ice maker can be securely brought into the final position. Similarly, it is the object of the present invention to provide a household refrigeration apparatus with such an ice maker.

These objects are solved by an ice maker and a household refrigeration apparatus according to the independent claims.

An aspect of the invention relates to an ice maker for installation in a household refrigeration apparatus, comprising:

a housing with an opening;

a storing bowl for ice, wherein the storing bowl comprises an opening, which is accessible from the top, wherein the storing bowl can be inserted into the housing through the opening of the housing, wherein the storing bowl is arranged in a final position in the inserted state, a position identifier, by which the position of the storing bowl can be captured, wherein the position identifier comprises a capturing sensor, a control electronic, which is arranged in a front area in depth direction of the ice maker, wherein the control electronic comprises a circuit board, wherein the capturing sensor is arranged on the circuit board.

A further aspect of the invention relates to a household refrigeration apparatus with an ice maker, wherein the ice maker comprises:

a housing with an opening;

a storing bowl for ice, wherein the storing bowl comprises an opening, which is accessible from the top, wherein the storing bowl can be inserted into the housing through the opening of the housing, wherein the storing bowl is arranged in a final position in the inserted state, a position identifier, by which the position of the storing bowl can be captured, wherein the position identifier comprises a capturing sensor, a control electronic, which is arranged in a front area in depth direction of the ice maker, wherein the control electronic comprises a circuit board, wherein the capturing sensor is arranged on the circuit board.

According to another aspect of the present disclosure, the front area is a front third area.

According to another aspect of the present disclosure, the circuit board is arranged laterally next to the storing bowl in width direction of the ice maker when the storing bowl is arranged in the final position.

According to another aspect of the present disclosure, the ice maker comprises an ice producer. The ice producer is arranged in the housing of the ice maker.

According to another aspect of the present disclosure, the ice producer comprises a sub housing. The ice producer comprises a drive. The drive is arranged in the sub housing. The circuit board is arranged in the sub housing.

According to another aspect of the present disclosure, the ice producer comprises an ice tray, in which the ice form parts are produced, wherein the ice tray is coupled to the drive to move the ice tray.

According to another aspect of the present disclosure, the ice maker comprises a heater, by which the ice form parts in the ice tray can be partially melted, wherein the heater is controlled by the control electronic.

According to another aspect of the present disclosure, the ice maker comprises an ejector, by which ice form parts in the ice tray can be ejected from the ice tray, wherein the ejector is controlled by the control electronic.

According to another aspect of the present disclosure, the ice maker comprises at least one temperature sensor, by which the temperature in the ice maker can be captured, wherein the temperature sensor is controlled by the control electronic.

According to another aspect of the present disclosure, the capturing sensor is a Hall sensor.

According to another aspect of the present disclosure, the position identifier comprises a magnet.

According to another aspect of the present disclosure, the magnet is arranged at the storing bowl.

According to another aspect of the present disclosure, the storing bowl comprises a first sidewall, which faces the circuit board upon introducing the storing bowl into the housing. The first sidewall comprises an upper border. The magnet is arranged adjacent to the upper border.

According to another aspect of the present disclosure, a receiving pocket for receiving the magnet is formed at the upper border. The magnet is arranged between an outer side of the first sidewall and a pocket wall of the receiving pocket.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, identical or functionally identical parts are provided with the same reference signs.

With indications of "top", "bottom", "front", "rear", "horizontal", "vertical", "depth direction", "width direction", "height direction", etc., the positions and orientations given in intended use and intended arrangement of the apparatus are specified.

Figure 1:
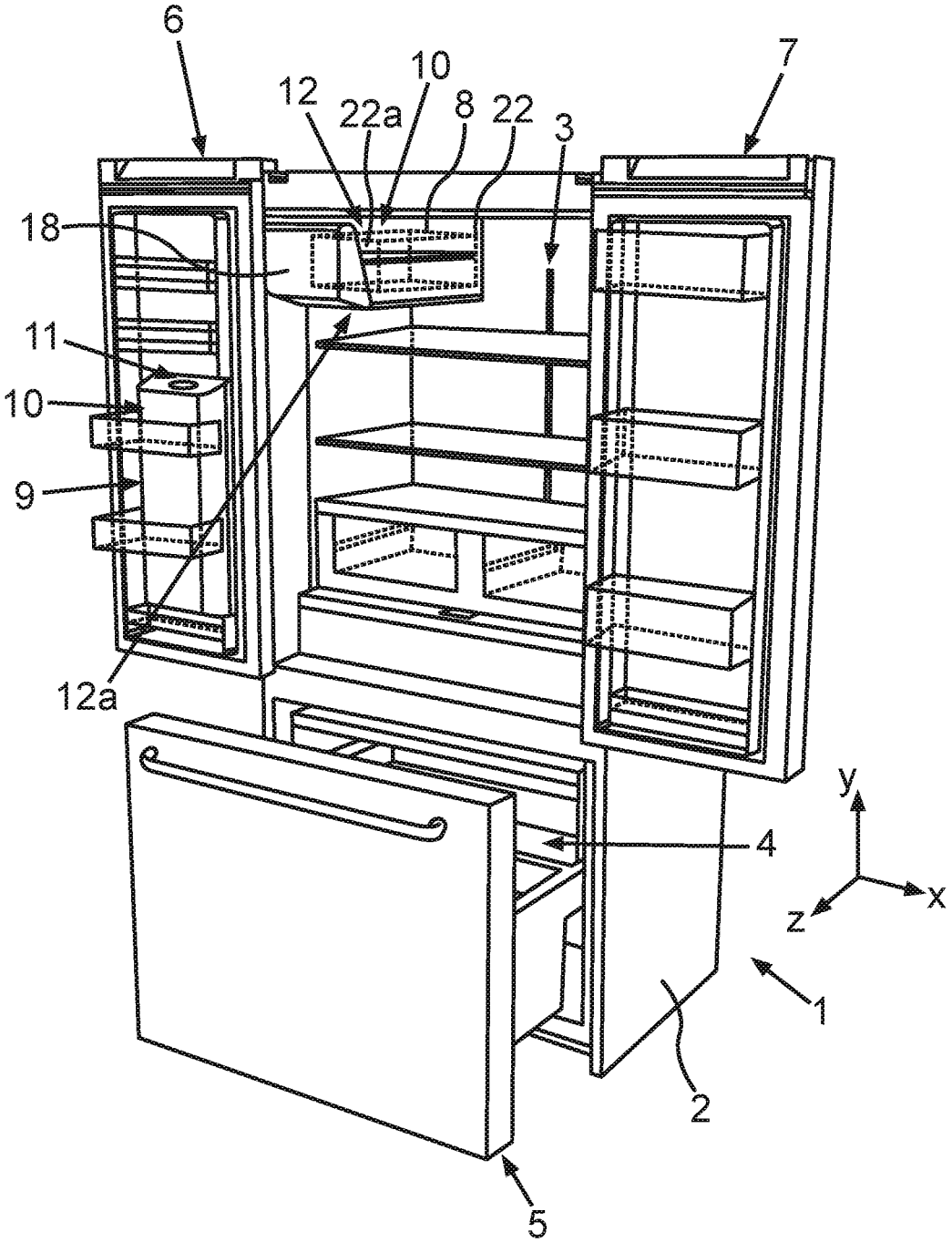
FIG. 1 is a perspective representation of an embodiment of a household refrigeration apparatus according to the invention with an embodiment of an ice maker according to the invention.

In FIG. 1 in a perspective view an embodiment of a household cooling appliance 1 is shown. The household cooling appliance 1 is configured for storing and preserving food items. In the shown embodiment the household cooling appliance 1 is a fridge freezer combination appliance. However, it can also be only a cooling or refrigeration appliance.

The shown household cooling appliance 1 comprises an outer housing 2. In the outer housing a first receiving space for food items is configured, which here is a refrigeration compartment 3. In an embodiment the household cooling appliance 1 moreover comprises a second receiving space for food items, which is separate from the first receiving space and which here is a freezer compartment 4. As can be recognized, in the embodiment shown here the refrigeration compartment 3 and the freezer compartment 4 are arranged one above the other in the height direction (y-direction) of the household cooling appliance 1. The freezer compartment 4, which is arranged further below, is capable of being locked by a door 5. The door 5 in the shown embodiment is a front wall of a drawer, which can be shifted linearly in the depth direction (z direction) of the household cooling appliance 1. The refrigeration compartment 3 is capable of being locked by two separate doors 6 and 7, which are shown in FIG. 1 in the opened state. The two separate doors 6 and 7 are capable of being pivoted about pivot axles, which are vertically oriented, and are arranged on the outer housing 2. The two doors 6 and 7 are arranged adjacent to each other in the width direction (x direction) and extend in the closed state in a front side plane. In particular also the door 5 in the closed stated extends in this plane, in which also the two doors 6 and 7 extend in the closed state.

In an embodiment the household cooling appliance 1 moreover comprises a dispenser 10 configured to output ice form elements or crushed ice. The dispenser 10 moreover can also optionally be configured to output a drink. In an embodiment the household cooling appliance 1 comprises a module 8. In an embodiment the dispenser 10 comprises said module 8.

The module 8 in the shown embodiment is arranged in the interior of the refrigeration compartment 3. This means that whilst the module 8 is arranged to be thermally insulated against the refrigeration compartment 3, however, that it is only accessible and reachable via the feed opening of the refrigeration compartment 3. Thus, the module 8 can only be made accessible, when at least the door 6 is opened.

The dispenser 10 in addition to the module 8 also comprises an output 9. The output 9 here is for instance configured to be integrally formed in the door 6. On an outer side of the door 6, which faces away from the refrigeration compartment 3 and then is also a front side, a niche is formed, in which a receiving container can be placed and in which then via the output 9 the ice form elements or the crushed ice can be output.

In the closed state of the door 6 the output 9 is coupled with the module 8 so that via an ice chute 11 formed here in the output 9 ice form elements or crushed ice can arrive at the output 9 from the module 8.

The module 8 can be an ice compartment 12*a*. The household cooling appliance 1 can then also be configured without an ice maker 12. The module 8 can also be an ice maker 12. The ice compartment 12*a* can be an integral part of the ice maker 12 if the household cooling appliance 1 comprises an ice maker 12.

In FIG. 1 an example for a household cooling appliance 1 comprising an ice maker 12 is schematically shown. The ice maker 12 is arranged in the refrigeration compartment 3. Viewed from the front side, it is arranged in a left top corner portion of the refrigeration compartment 3. The ice maker 12 is arranged to be thermally insulated from the remaining volume of the receiving space 3. The ice maker is only accessible, if the door 6 is opened.

Figure 2:
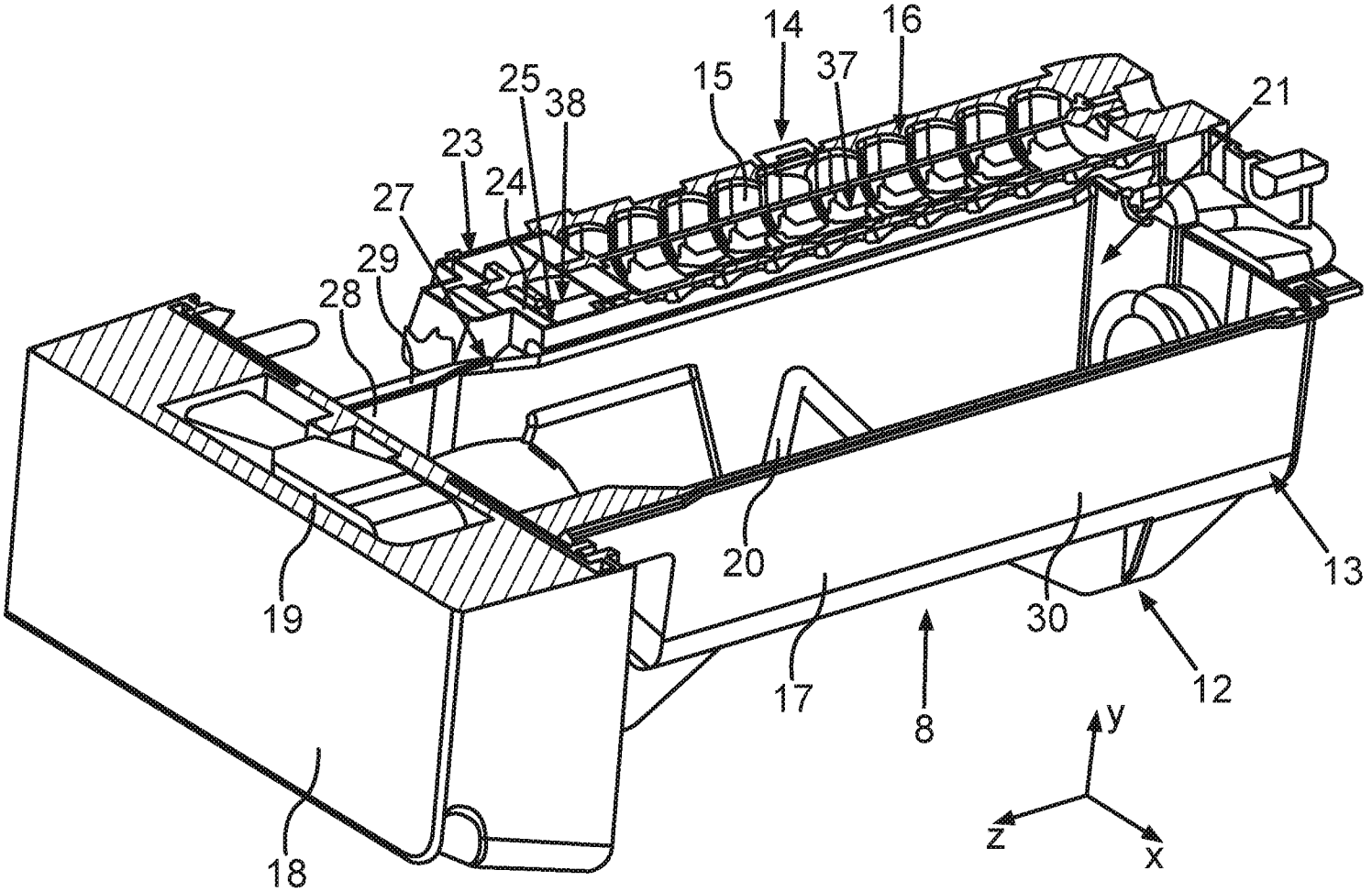
FIG. 2 is a perspective representation of partial components of an embodiment of an ice maker according to the invention with a storing bowl, which is arranged in a first insertion position in the housing of the ice maker.

In FIG. 2, an arrangement of partial components of the ice maker 12 is shown in a perspective representation.

In FIG. 2, partial components of the module 8 are illustrated. This module 8 comprises a storing bowl 13. Ice form parts, in particular ice cubes, are stored in this storing bowl 13. Moreover, the module 8 comprises an ice producer 14. This ice producer 14 produces the ice form parts. Thereto, water is frozen. The water is introduced in form areas 15. The form areas 15 are formed in an ice tray 16. The ice tray 16 is separate to the storing bowl 13. The ice tray 16 is a constituent of the ice producer 14.

The ice producer 14 is arranged next to the storing bowl 13 in width direction (x-direction). In an embodiment, the storing bowl 13 comprises a tray 17. Moreover, it comprises a front wall 18. In an embodiment, a cutter arrangement 19 is arranged at the front wall 18. Ice form parts stored in the tray 17 can be crushed by this cutter arrangement 19 upon leading out of the tray 17. For leading the ice form parts out of the tray 17, the module 8 comprises a conveyor 20. The conveyor 20 can be a screw conveyor. The storing bowl 13, in particular the tray 17, comprises an opening 21. This opening 21 is accessible from the top.

Moreover, the module 8 comprises a housing 22, as it is apparent in FIG. 1. The housing 22 is not shown in FIG. 2. The storing bowl 13 and the ice producer 14 are arranged in the housing 22. The storing bowl 13 can be inserted into and withdrawn from this housing 22 in depth direction (z-direction). In this context, the front wall 18 also forms a front wall of the housing 22 in the embodiment.

In an embodiment, the ice maker 12 comprises a control electronic 23, as it is shown in FIG. 2. This control electronic 23 comprises a circuit board 24. A capturing sensor 26 (FIGS. 6 and 7) is arranged on this circuit board 24. This capturing sensor 26 is a constituent of a position identifier 25. The position identifier 25 is a constituent of the ice maker 12. In particular, the position identifier 25 is a constituent of the module 8. The position of the storing bowl 13 can be detected by the position identifier 25. In an embodiment, it can thereby be captured when the storing bowl 13 is arranged in its completely inserted final position in the housing 22. This capturing sensor 26 is a capturing sensor. In an embodiment, it is a Hall sensor.

Moreover, the position identifier 25 comprises at least one magnetically interacting component. In an embodiment, the magnetically interacting component is a magnet 27. This magnet 27 is separate to the capturing sensor 26. The magnet 27 is arranged at the storing bowl 13. In an embodiment, the magnet 27 is arranged at the tray 17. In an embodiment, the magnet 27 is arranged at a vertical sidewall 28 of the tray 17. In an embodiment, the magnet 27 is formed at an upper border 29 of this vertical sidewall 28. The sidewall 28 is the sidewall facing the ice producer 14. Moreover, the tray 17 comprises a further vertical sidewall 30. It is further spaced from the ice producer 14 than the first vertical sidewall 28 in width direction.

In FIG. 2, the storing bowl 13 is shown in an inserted intermediate position, which is not yet the completely inserted final position.

Figure 3:
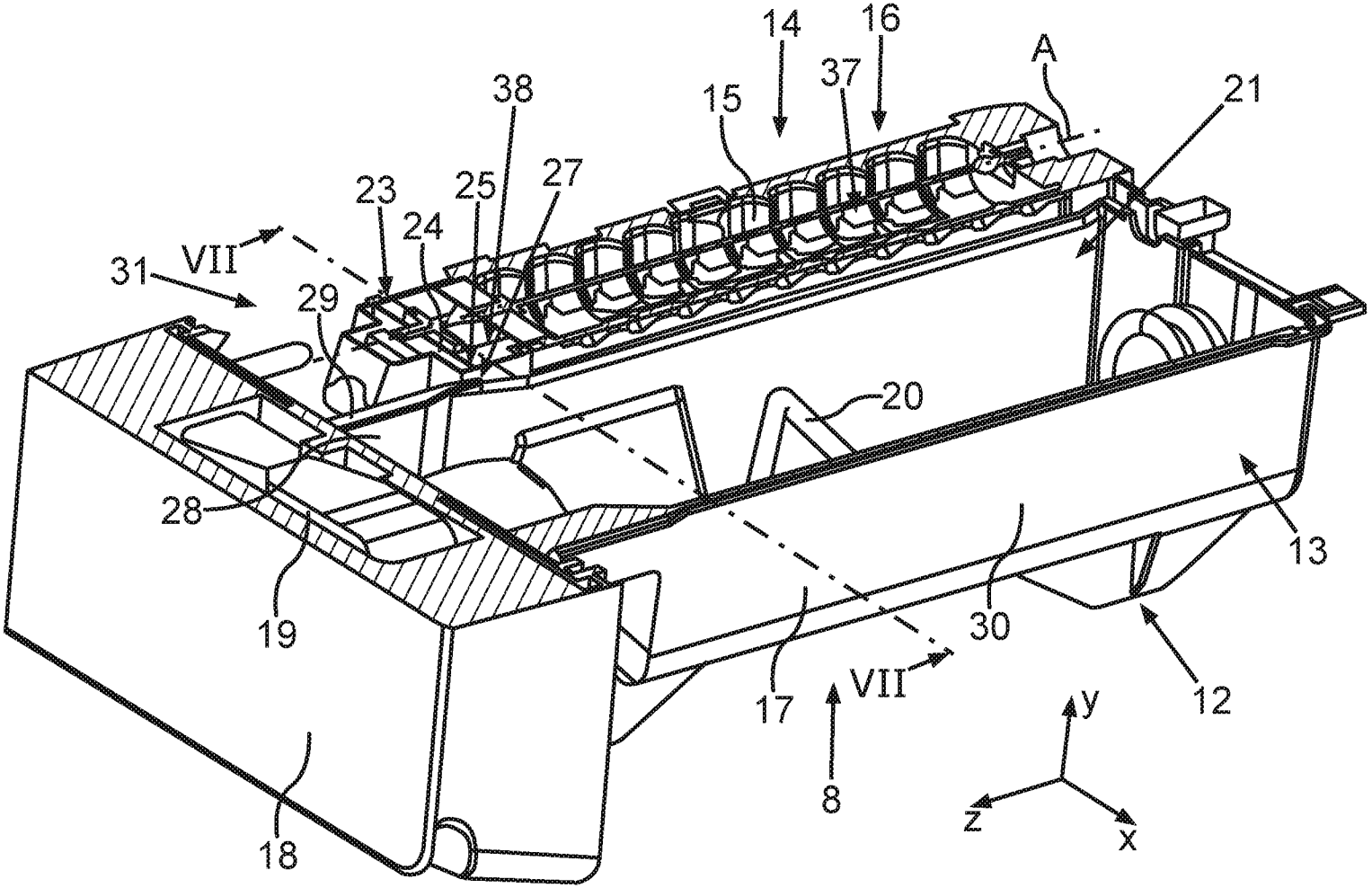
FIG. 3 is a perspective representation corresponding to FIG. 2, wherein the storing bowl is arranged in its completely inserted final position in FIG. 3.

In FIG. 3, a representation of the components according to FIG. 2 is shown in this context. However, the storing bowl 13 is shown in the completely inserted final position in FIG. 3. In this state, the magnet 27 is arranged immediately adjacent to the capturing sensor 26. Due to the magnetic interaction between the capturing sensor 26 and the magnet 27, this final position is uniquely detected. In particular, it is detected without contact in this respect. Thereby, the inserted final position can be reliably and securely identified.

The position of the capturing sensor 26 is particularly advantageous. The circuit board 24 of the originally present control electronic 23 is also utilized to receive this capturing sensor 26. Therefore, a separate circuit board for the capturing sensor 26 is not required.

Furthermore, it is advantageous, as it is apparent in FIG. 3, that this circuit board 24 with the capturing sensor 25 is arranged in a front area 31 of the module 8. In this respect, the front area 31 is to be viewed in depth direction. In an embodiment, this circuit board 24 with the capturing sensor 26 is arranged in a front third of length of the module 8. Therein, the length is measured in depth direction. By this front-side positioning of the circuit board 24, installation space is released in the rear area of the module 8. In an embodiment, the ice producer 14 and the storing bowl 13 can be arranged in improved manner in this respect.

The construction of the module 8 is simplified by this arrangement of the circuit board 24 displaced to the front. The complexity of the ice maker 12 is thereby reduced. Less electronic components and less current feeds are required. Moreover, the accessibility to the circuit board 24 is simpler. Then, the accessibility to the capturing sensor 25 is also simpler.

By the configuration of the capturing sensor 26 as a Hall sensor, both the presence of the storing bowl 13 in principle and the position of this storing bowl 13 in depth direction can be very accurately determined.

Figure 4:
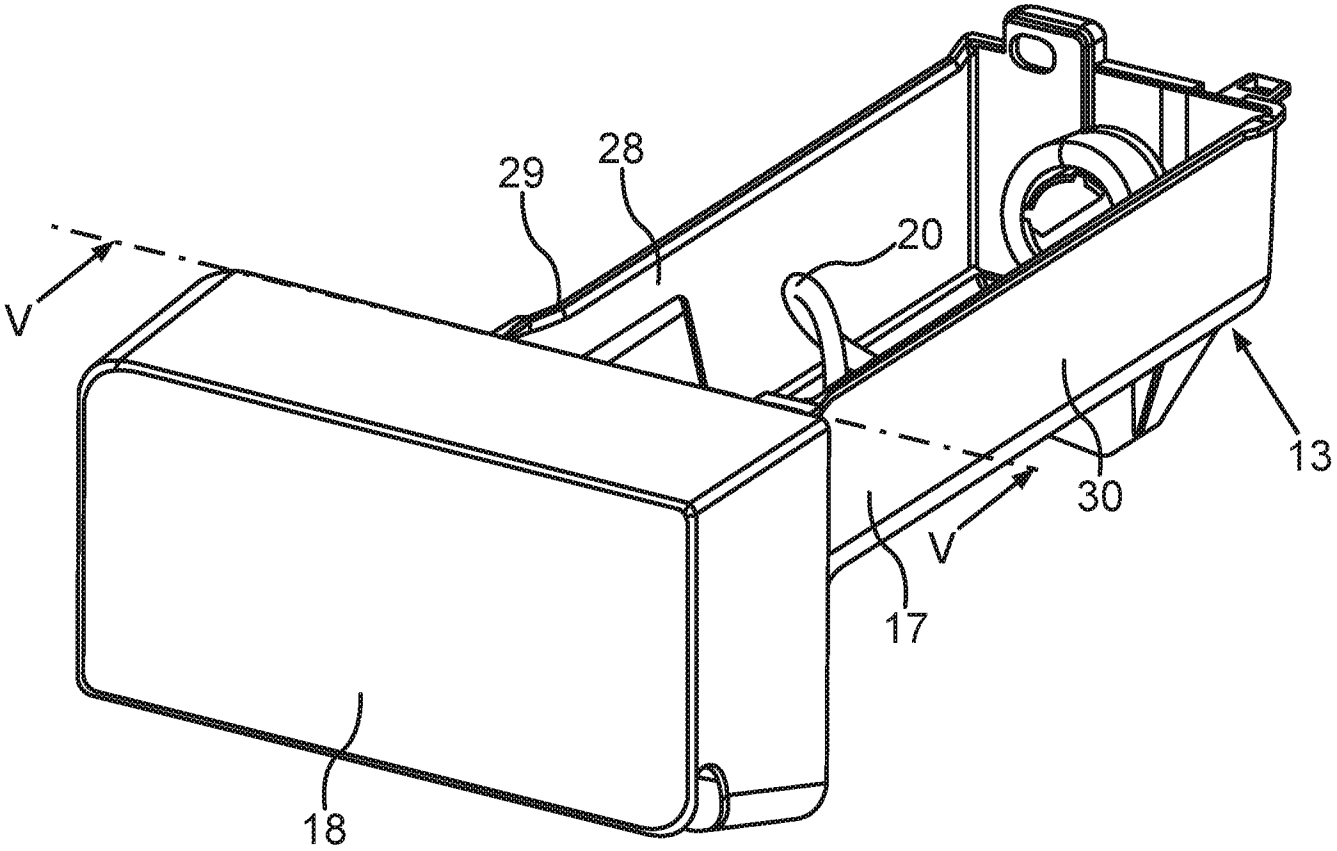
FIG. 4 is a perspective representation of the storing bowl.

In FIG. 4, the storing bowl 13 is shown in a perspective representation.

Figure 5:
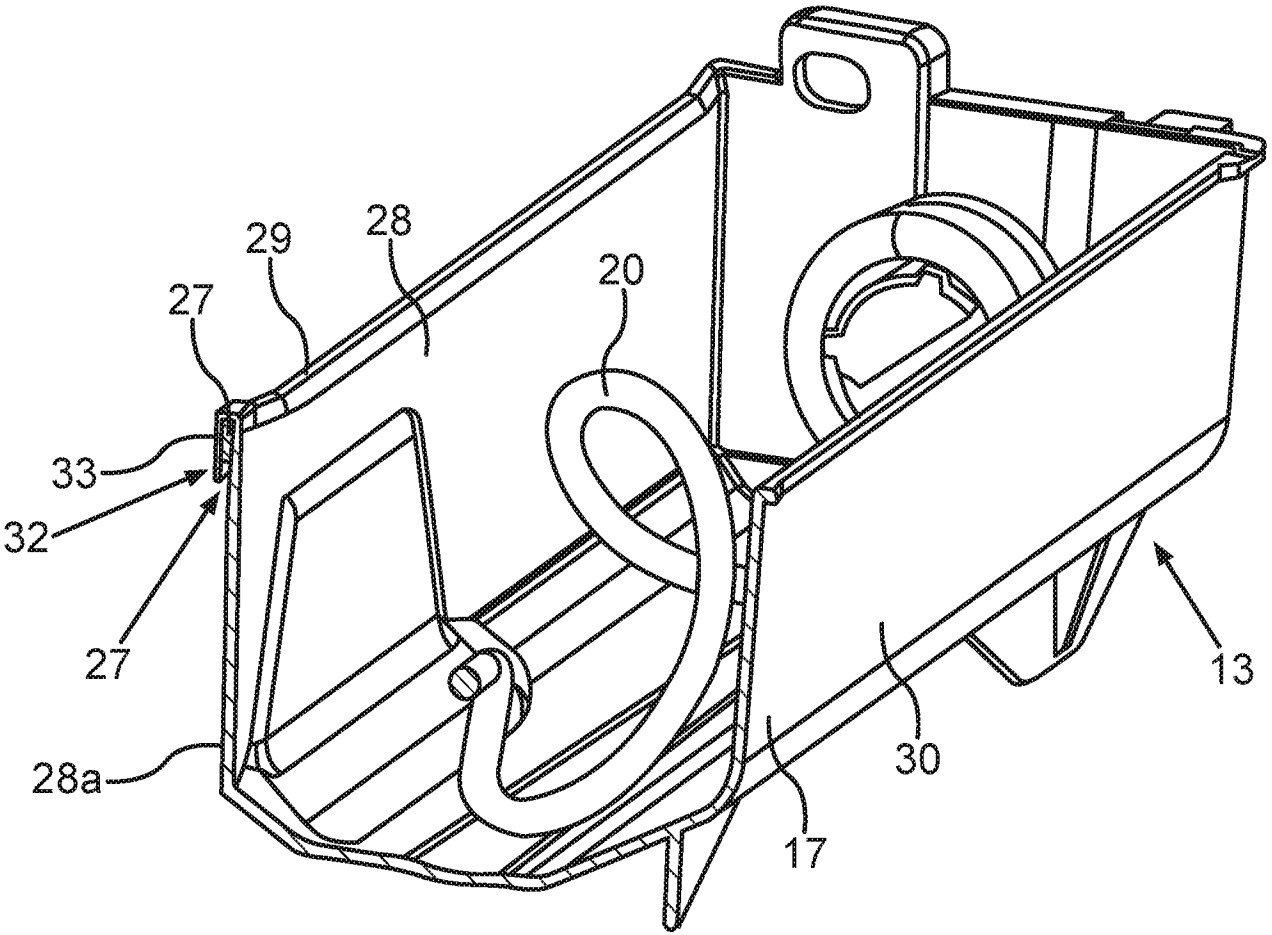
FIG. 5 is a perspective sectional representation through the storing bowl according to FIG. 4.

In FIG. 5, the storing bowl 13 is shown in a sectional representation along the sectional line V-V in FIG. 4. It is apparent that a receiving pocket 32 for the magnet 27 is formed at this upper border 29. Thereby, the magnet 27 is arranged between an outer side 28*a* of the first sidewall 28 and a pocket wall 33 of the receiving pocket 32. In particular, it is arranged in the receiving pocket 32 fixed in position.

Figure 6:
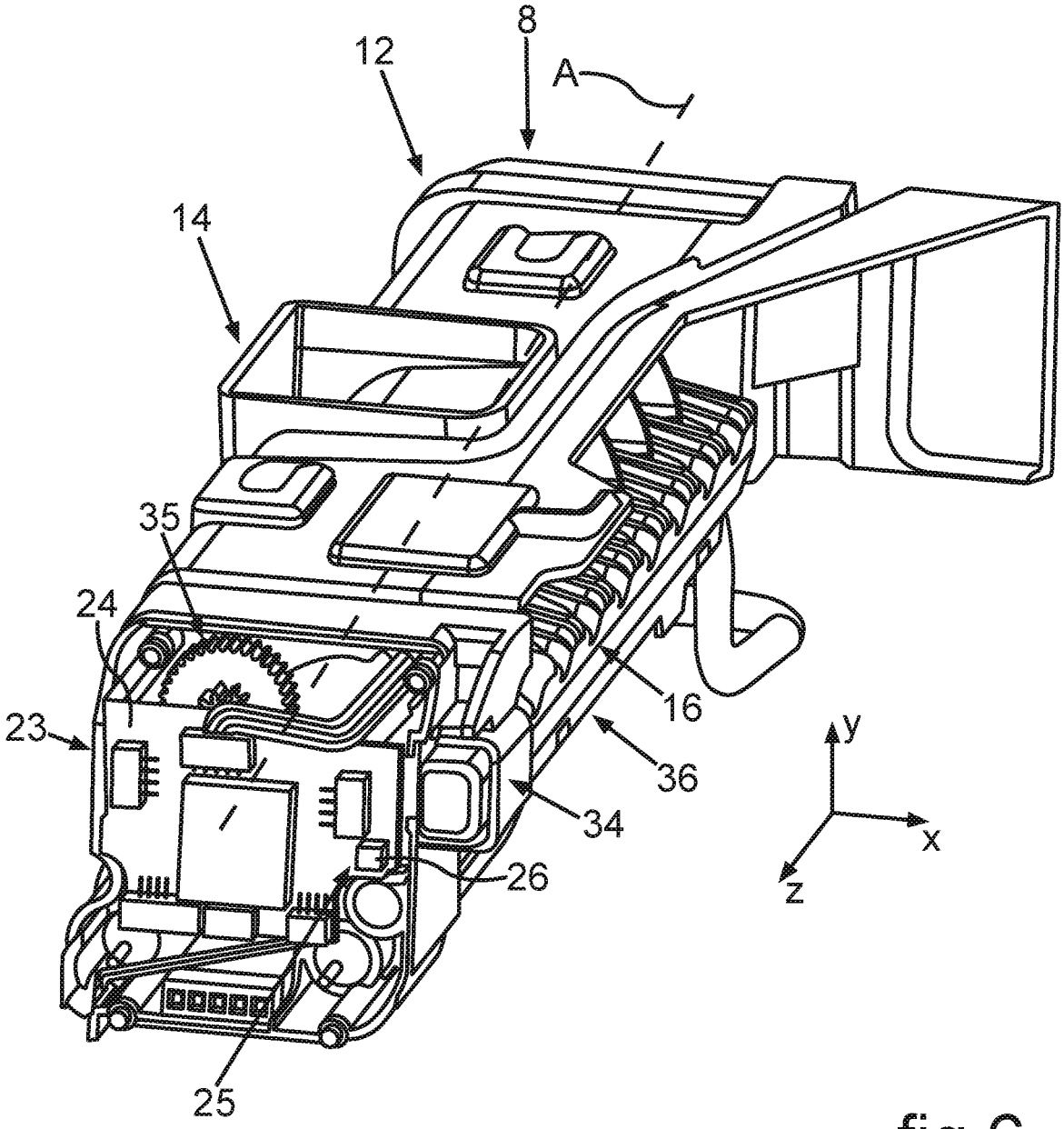
FIG. 6 is a perspective representation of the ice producer of the ice maker according to FIG. 2 and FIG. 3.

In FIG. 6, the ice producer 14 of the ice maker 12, in particular of the module 8, is illustrated in a perspective representation. The circuit board 24 of the control electronic 23 is apparent. Moreover, the capturing sensor 26 is also shown. As is apparent, a sub housing 34 is provided in an embodiment. The sub housing 34 is separate to the housing 22. The sub housing 34 is arranged in the housing 22. The sub housing 34 receives the circuit board 24 and the capturing sensor 26.

As is apparent in FIG. 3, the circuit board 24 is arranged laterally of and next to the tray 17 viewed in width direction in the completely inserted final position of the storing bowl 13. Moreover, the ice producer 14 comprises a drive 35, as it is shown in FIG. 6. In an embodiment, the drive 35 is also arranged in the sub housing 34. The drive 35 is provided for mechanically moving the ice tray 16. In particular, the ice tray 16 can be rotated, in particular twisted, around an axis A, as it is drawn in FIG. 6, by the drive 35.

In an embodiment, it is provided that the control electronic 23 controls the drive 35. In an embodiment, it is provided that the control electronic 23 controls a heater 36. The heater 36, which is a constituent of the module 8, allows partially melting the ice form parts in the ice tray 16. Thereby, the ice form parts can be simpler removed from the ice tray 16.

In an embodiment, it is provided that the module 8, in particular the ice producer 14, comprises an ejector 37, as it is indicated in FIG. 2 and FIG. 3. The ejector 37 allows shifting the ice form parts out of the form areas 15. The ejector 37 can be controlled by the control electronic 23.

Moreover, it is provided in an embodiment that the ice maker 12, in particular the module 8, comprises a temperature sensor 38, as it is symbolically shown in FIG. 2 and FIG. 3. The temperature can be measured in particular in the module 8 by the temperature sensor 38. In particular, the temperature sensor 38 is connected to the control electronic 23. The information captured by the temperature sensor 38 can be processed by the control electronic 23. In an embodiment the ice maker 12 comprises at least one optical sensor. Said optical sensor detects the amount of ice form elements in the ice maker 12. In an embodiment said optical sensor is integrated in the temperature sensor 38. Therefore an sensor-module with at least two sensors is arranged.

Moreover, in an embodiment, the control electronic 23 is formed to the effect that it controls the entire process flow from producing ice form parts in the ice producer 14 until outputting the ice form parts from the ice tray 16 into the storing bowl 13. In particular, leading the ice form parts out of the storing bowl 13 by means of the conveyor 20 is also controlled by the control electronic 23. In particular, the cutter arrangement 19 is also controlled by this control electronic 23.

Figure 7:
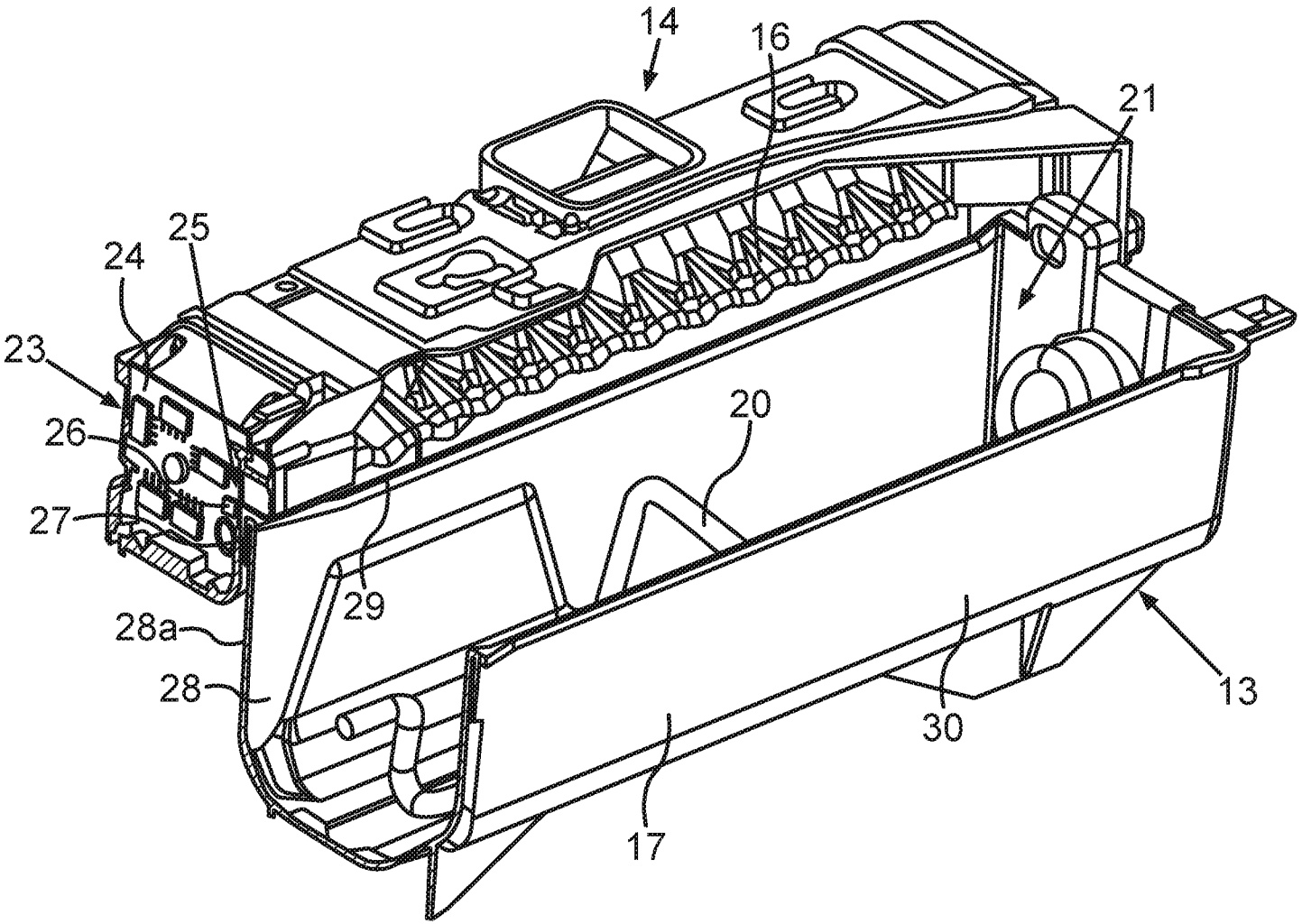
FIG. 7 is a perspective sectional representation through the ice maker according to FIG. 3.

In FIG. 7, the module 8 is shown in a perspective sectional representation. In this context, the sectional line is shown along the sectional line VII-VII in FIG. 3. The sectional plane is drawn through the magnet 27 and the capturing sensor 26. As is apparent in FIG. 7 thereto, the capturing sensor 26 is arranged directly above the magnet 27 viewed in height direction in this final position of the storing bowl 13. The magnet 27 is arranged overlapping with the capturing sensor 26 in width direction.

In an embodiment, the front area is a front third area.

In an embodiment, the circuit board is arranged laterally next to the storing bowl in width direction of the ice maker when the storing bowl is arranged in the final position.

In an embodiment, the ice maker comprises an ice producer. The ice producer is arranged in the housing of the ice maker.

In an embodiment, the ice producer comprises a sub housing. The ice producer comprises a drive. The drive is arranged in the sub housing. The circuit board is arranged in the sub housing in an embodiment.

In an embodiment, the ice producer comprises an ice tray, in which the ice form parts are produced, wherein the ice tray is coupled to the drive to move the ice tray.

In an embodiment, the ice maker comprises a heater, by which the ice form parts in the ice tray can be partially melted, wherein the heater is controlled by the control electronic.

In an embodiment, the ice maker comprises an ejector, by which ice form parts in the ice tray can be ejected from the ice tray, wherein the ejector is controlled by the control electronic.

In an embodiment, the ice maker comprises at least one temperature sensor, by which the temperature in the ice maker can be captured, wherein the temperature sensor is controlled by the control electronic.

In an embodiment, the capturing sensor is a Hall sensor.

In an embodiment, the position identifier comprises a magnet. In an embodiment, the magnet is arranged at the storing bowl.

In an embodiment, the storing bowl comprises a first sidewall, which faces the circuit board upon introducing the storing bowl into the housing. The first sidewall comprises an upper border. The magnet is arranged adjacent to the upper border.

In an embodiment, a receiving pocket for receiving the magnet is formed at the upper border. The magnet is arranged between an outer side of the first sidewall and a pocket wall of the receiving pocket.

The following is a list of reference numerals used in the above description of the invention with reference to the drawing figures:

1 household cooling appliance
2 outer housing
3 refrigeration compartment
4 freezer compartment
5 door
6 door
7 door
8 module
9 output
10 dispenser
11 ice chute
12 ice maker
12*a* ice compartment
13 storing bowl
14 ice producer
15 form area
16 ice tray
17 tray
18 front wall
19 cutter arrangement
20 conveyor
21 opening
22 housing
23 control electronic
24 circuit board
25 position identifier
26 capturing sensor
27 magnet
28 vertical sidewall
28*a* outer side
29 upper border
30 vertical sidewall
31 front area
32 receiving pocket
33 pocket wall
34 sub housing
35 drive
36 heater
37 ejector
38 temperature sensor
x width direction
z depth direction
A axis

The invention claimed is:

1. An ice maker for installation in a household refrigeration apparatus, the ice maker comprising:

a housing with an opening, a storing bowl for ice, wherein the storing bowl is formed with an opening, which is accessible from the top, wherein the storing bowl can be inserted into the housing through the opening of the housing and wherein the storing bowl is arranged in a final position at the housing in the inserted state, a position identifier capturing the position of the storing bowl, wherein the position identifier comprises a capturing sensor, a control electronic, which is arranged in a front area in depth direction of the ice maker, wherein the control electronic comprises a circuit board, and the capturing sensor is arranged on the circuit board.

2. The ice maker according to claim 1, wherein the front area is a front third area of the entire length of the ice maker.

3. The ice maker according to claim 1, wherein the circuit board is arranged laterally next to the storing bowl in width direction of the ice maker, when the storing bowl is arranged in the final position.

4. The ice maker according to claim 1, comprising an ice producer, which is arranged in the housing.

5. The ice maker according to claim 4, wherein the ice producer comprises a sub housing and comprises a drive, which is arranged in the sub housing, wherein the circuit board is arranged in the sub housing.

6. The ice maker according to claim 5, wherein the ice producer comprises an ice tray, in which the ice form parts are produced, wherein the ice tray is coupled to the drive, to move the ice tray.

7. The ice maker according to claim 6, comprising a heater, by which the ice form parts can be partially melted in the ice tray, wherein the heater is controlled by the control electronic.

8. The ice maker according to claim 6, comprising an ejector, by which ice form parts in the ice tray can be ejected from the ice tray, wherein the ejector is controlled by the control electronic.

9. The ice maker according to claim 1, comprising at least one temperature sensor, by which the temperature in the ice maker can be captured, wherein the temperature sensor is controlled by the control electronic.

10. The ice maker according to claim 1, wherein the capturing sensor is a Hall sensor.

11. The ice maker according to claim 1, wherein the position identifier comprises a magnet, which is arranged at the storing bowl.

12. The ice maker according to claim 11, wherein the storing bowl comprises a first sidewall, which faces the circuit board upon introducing the storing bowl into the housing, wherein the first sidewall comprises an upper border, and the magnet is arranged adjacent to the upper border.

13. The ice maker according to claim 12, wherein a receiving pocket for receiving the magnet is formed at the upper border such that the magnet is arranged between an outer side of the first sidewall and a pocket wall of the receiving pocket.

14. A household refrigeration apparatus, comprising:

an ice maker, the ice maker having:

a housing with an opening, a storing bowl for ice, wherein the storing bowl comprises an opening, which is accessible from the top, wherein the storing bowl can be inserted into the housing through the opening of the housing, wherein the storing bowl is arranged in a final position at the housing in the inserted state, a position identifier capturing the position of the storing bowl, wherein the position identifier comprises a capturing sensor, a control electronic, which is arranged in a front area in depth direction of the ice maker, wherein the control electronic comprises a circuit board, wherein the capturing sensor is arranged on the circuit board.

* * * * *